US009765451B2

(12) United States Patent
Karaca et al.

(10) Patent No.: US 9,765,451 B2
(45) Date of Patent: Sep. 19, 2017

(54) FUNCTIONAL POLYESTER THREAD COMPRISING PEARLITE AND THE PRODUCTION METHOD THEREOF

(71) Applicants: Esra Karaca, Bursa (TR); Sunay Ömeroglu, Bursa (TR); Okan Akçam, Bursa (TR)

(72) Inventors: Esra Karaca, Bursa (TR); Sunay Ömeroglu, Bursa (TR); Okan Akçam, Bursa (TR)

( * ) Notice: Subject to any disclaimer, the term of this patent is extended or adjusted under 35 U.S.C. 154(b) by 21 days.

(21) Appl. No.: 14/891,401

(22) PCT Filed: May 16, 2014

(86) PCT No.: PCT/TR2014/000168

§ 371 (c)(1),
(2) Date: Nov. 16, 2015

(87) PCT Pub. No.: WO2014/185875

PCT Pub. Date: Nov. 20, 2014

(65) Prior Publication Data

US 2016/0083869 A1 Mar. 24, 2016

(30) Foreign Application Priority Data

May 16, 2013 (TR) ..... a2013 05887

(51) Int. Cl.
*D01F 6/62* (2006.01)
*D01F 1/10* (2006.01)

(52) U.S. Cl.
CPC ..... *D01F 6/62* (2013.01); *D01F 1/10* (2013.01); *D01F 1/103* (2013.01)

(58) Field of Classification Search
None
See application file for complete search history.

(56) References Cited

U.S. PATENT DOCUMENTS 5,527,387 A * 6/1996 Andersen ..... B28B 1/52 106/693
6,359,050 B1 * 3/2002 Dohrer ..... C08J 5/18 524/425
2006/0135668 A1 * 6/2006 Hayes ..... B32B 27/36 524/430
2009/0253323 A1 * 10/2009 Mueller ..... B32B 5/08 442/150

FOREIGN PATENT DOCUMENTS

CN 1865545 A * 11/2006
CN 102766986 A 11/2012
JP 2009007681 A 1/2009

OTHER PUBLICATIONS

International Search Report for corresponding International Application No. PCT/TR2014/000168.

* cited by examiner

*Primary Examiner* — Peter A Salamon
(74) *Attorney, Agent, or Firm* — Egbert Law Offices, PLLC

(57) ABSTRACT

A functional polyester thread includes nanosized and surface treated pearlite, whose water absorbance, thermal and noise insulation, and antibacterial protection properties are improved in order to be used in industries like automotive, filter, textile and construction, etc. industries. A production method for polyester thread is also disclosed.

3 Claims, 1 Drawing Sheet

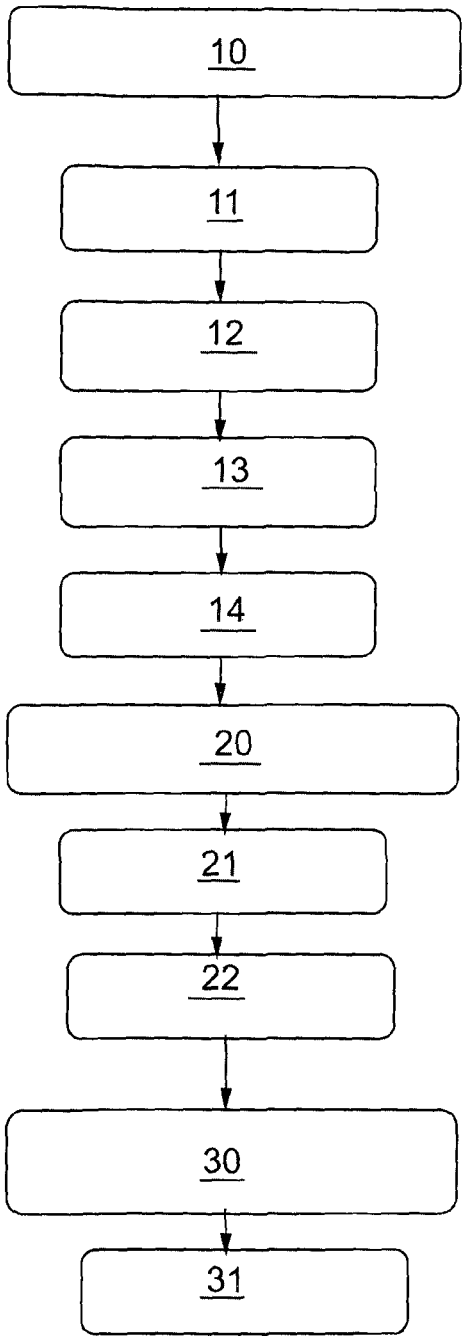
10
11
12
13
14
20
21
22
30
31

FUNCTIONAL POLYESTER THREAD COMPRISING PEARLITE AND THE PRODUCTION METHOD THEREOF

TECHNICAL FIELD

The present invention relates to a polyester thread whose water absorbance, thermal and noise insulation, antibacterial protection, etc. properties are improved in order to be used in industries like automotive, filter, textile and construction, etc, industries, and relates to the production method of said polyester thread.

PRIOR ART

Threads, which are the raw materials of textile products, have been used in garment industry, home textile and technical textile production for many years. The properties differentiating technical textiles from normal textile materials are the performances of technical textiles during usage. The factors providing this performance are the raw materials used (polymer material, thread type, etc.) and the production methods. Therefore, the studies related to the modification of the properties of chemical threads by means of pluralities of methods, and the studies related to thread production with pluralities of properties are gradually increasing today.

Polyester (PET) is one of the polymers frequently used in textile and plastic industry. Since the usage area of polyester is wide, pluralities of researches and modifications for changing the properties of polyester are realized. The modification of the chemical threads can be realized during production and through the product obtained after production. During production, the modification of threads can be realized by changing the process conditions, by changing the thread cross section shapes and by adding additives into the polymer in various proportions. After production, the modification of threads is realized by application of various finishing processes onto the thread surface or by coating the thread surface. As a result of these applications and modifications, threads with different properties can be obtained. Additives in various dimensions and proportions added to the polymer material during production can change the various physical and chemical properties like color, resistance, radiance, dirt and water resistance, thermal conductivity, inflammability, UV resistance and antibacterial protection property of the final product, and can change the performance of the product during usage.

Two basic methods are used for modifying textile materials by means of additives which are in nano dimensions. In the first method, nano materials are added into the textile threads during production. In the second method, nano materials are applied onto the surface of the textile materials during the finishing processes. During the finishing processes, conventional methods used for modifying threads and fabrics by means of nano materials generally have temporary effects, and threads and fabrics lose their properties after processes like washing and abrading. However, the nano materials added into the threads bind to the threads in a stronger manner because of the high surface energies thereof, and they increase the permanence of the property provided. The most important disadvantage of the known state of the art is that the modifications realized during the thread production step and after the thread production step generally improve only one property of the thread.

As a result, because of all of the abovementioned problems, an improvement is required in the related technical field.

BRIEF DESCRIPTION OF THE INVENTION

The present invention relates to a polyester thread and the production method thereof, for eliminating the above mentioned disadvantages and for bringing new advantages to the related technical field.

The main object of the present invention is to provide a polyester thread whose properties like water absorbance, thermal and noise insulation, antibacterial protection are improved.

In order to realize all of the abovementioned objects and the objects which are to be deducted from the detailed description below, the present invention is a production method for polyester thread comprising pearlite in order to improve the physical properties of polyester threads used in pluralities of sectors like textile products, construction, automotive, defense and medicine and comprising the steps of:

a) melting a polymer based material, desired to be produced as thread, in the screwed extruder
b) transferring said melt to the melt extrusion thread machine
c) extruding the melt in said melt extrusion thread machine by passing through holes at certain dimensions
d) wrapping the extruded thread onto a structure like bobbin, etc.

Accordingly, the subject matter method is characterized by comprising the following sub-steps of:

e) grinding pearlite in an attritor such that the pearlite is reduced to nano dimension prior to step "a"
f) realizing surface modification in order to prevent flaking of pearlite in nano dimension after step "e"
g) taking the pearlite to a polymer based carrier media after step "f" and obtaining polymer master-batch comprising pearlite
h) adding said master-batches comprising pearlite to step "a" and melting said master-batches together with polymer based main material in the screwed extruder.

In a preferred embodiment of the subject matter invention, the step "f" comprises the sub-steps of:

i) adding an amine solution to the water comprising pearlite therein as colloidal, and mixing the mixture in a mechanical and ultrasonic manner
ii) centrifuging the colloidal mixture and precipitating the pearlite
iii) washing the pearlite in order for the excessive solution on the pearlite to be removed, and drying the pearlite in a heater In another preferred embodiment of the subject matter invention, the step "g" comprises the sub-steps of:

i) melting the polymer used as the carrier media
ii) adding pearlite powders, whose surface is modified, into the melt polymer, and mixing thereof
iii) obtaining master-batch units from the prepared mixture In order to realize all of the abovementioned objects and the objects which are to be deducted from the detailed description below, the present invention is a functional polyester thread used in pluralities of sectors like textile products, construction, automotive, defense and medicine. Accordingly, said fabric formed by said polyester thread comprises powder pearlite addition for improving water absorbance, thermal and noise insulation, antibacterial protection properties of the fabric.

In another preferred embodiment of the subject matter invention, the water absorption duration, when compared with the fabric woven from polyester thread not comprising pearlite, is shorter in proportion of 24-36%. The water absorption duration of the fabric woven from functional polyester thread is shorter in proportion of 24-36% when compared with the fabric woven from polyester thread not comprising pearlite.

In another preferred embodiment of the subject matter invention, the thermal resistance of the fabric woven from functional polyester thread is greater in proportion of 10-134% when compared with the fabric woven from polyester thread not comprising pearlite.

In another preferred embodiment of the subject matter invention, the bacteria level decreasing percent of the fabric woven from functional polyester thread is greater in proportion of 10-122% when compared with the fabric woven from polyester thread not comprising pearlite.

In another preferred embodiment of the subject matter invention, the noise absorption coefficient in frequency range 2000-6300 Hz for the fabric woven from functional polyester thread is greater in proportion of 17-169% when compared with the fabric woven from polyester thread not comprising pearlite.

BRIEF DESCRIPTION OF THE FIGURES

In FIG. 1, a representative view of the production flow is given.

REFERENCE NUMBERS

10 Processing of pearlite particles
11 Grinding
12 Surface modification
13 Centrifuging
14 Drying
20 Master-batch output comprising pearlite
21 Pearlite addition into poly-butylene terephthalate (PBT)
22 Shaping
30 Thread output comprising pearlite
31 Feeding to the extruder and melt extrusion

THE DETAILED DESCRIPTION OF THE INVENTION

In this detailed description, the subject matter polyester thread is explained with references to examples without forming any restrictive effect in order to make the subject more understandable.

In the present invention, the production steps of polyester thread whose physical properties like water absorbance, thermal and noise insulation, antibacterial protection, etc. are improved are described, and besides, the properties of the final product are described. More particularly, in the present invention, the preparation of poly-butylene terephthalate master-batch unit comprising pearlite and the addition thereof to the polyethylene terephthalate based thread for improving the physical properties are described. In thread production, melt extrusion method is used. Poly-butylene terephthalate will be described as PBT in the present specification. Polyethylene terephthalate will be described as PET in the present specification.

The production of the subject matter thread generally comprises the following 3 steps:

Processing of pearlite particles (10)
Master-batch output comprising pearlite (20)
Thread output comprising pearlite (30)

The step of processing of pearlite particles (10), which is the first step, comprises the following sub-steps.

Grinding (11)
Surface modification (12)
Centrifuging (13)
Drying (14)

The step of master-batch output comprising pearlite (20), which is the second step, comprises the following sub-steps.

Pearlite addition into PBT (21)
Shaping (22)

In the present invention for improving the physical properties of polyester thread, expanded micronized powder pearlite is used because of the positive physical and chemical characteristic thereof. Pearlite, having an inorganic structure, is a substance having a porous structure, having high thermal and noise insulation property and which does not react chemically and which is not dissolved in water thanks to the light and stable chemical structure thereof. By means of the addition of pearlite to the polyester thread, a simultaneous and permanent improvement is provided in the thread thanks to said properties.

The Step of Processing of Pearlite Particles (10)

Grinding (11)

Since filament in average of 15 microns diameter is obtained from each of the nozzle holes to be used in polyester thread production by means of the melt extrusion method, the particle dimension of the additive to be used in polyester production with addition must be below 1 micron. Therefore, the particle dimension of pearlite is reduced to nano dimension prior to the thread production step. In order to reduce the particle dimension, first of all, pearlite is grinded in a wet manner with the help of attritor, afterwards it is dried and finally, the dry pearlite is grinded in the attritor again, and the particle dimension is reduced to the nano level.

The parameters for the attritor used for wet grinding and dry grinding are given in Table 1 and Table 2 in a separate manner.

TABLE 1

| Attritor parameters for the wet grinding process of pearlite | |
|---|---|
| Operation Speed | 1000-2000 rev/min |
| Operation Environment | Water bath |
| Heating | None |
| Grinding Ball Material | Zirconium oxide |
| Grinding Ball Dimension | 0.4-0.6 mm |
| Operation Duration | 16 hours |

TABLE 2

| Attritor parameters for the dry grinding process of pearlite | |
|---|---|
| Operation Speed | 200-400 rev/min |
| Operation Environment | Dry |
| Heating | None |
| Grinding Ball Material | Yttrium Zirconium |
| Grinding Ball Dimension | 10 mm |

Surface Modification (12)

Surface modification is realized to pearlite, grinded to nano dimension and whose surface area is widened, by means of an amine based surface active material, in order to prevent the flaking which will occur as a result of the humidity in air, and thus, the pearlite particles push each other. As the surface active material, 78% BELFASIN 2015 solution is used which is a commercial amine and having 700 g/mole molecular weight.

For the surface modification of pearlite, first of all, 0.5 grams of pearlite in average is added into 50 ml of ultra-pure water bath in a manner that weight/volume proportion is 0.1%, and the colloidal solution prepared is mixed in a mechanical and ultrasonic manner for duration of approximately 30 minutes. Meanwhile, an amine solution is prepared in another vessel. For said amine solution, first of all, pure water is brought to a level by means of NaOH and HCl such that the pH thereof is approximately between 2.5 and 4. Afterwards, BELFASIN 2015, which is a commercial amine solution and having proportion of $1\times10^{-2}$ M, is added into the pure water whose pH value is adjusted.

In this step, amine solution is added to pearlite provided in the pure water bath as a colloidal. Meanwhile, mixing is realized in a mechanical and ultrasonic manner continuously, in order for the surface of the pearlite particles, provided in the pearlite+water+amine mixture, to be coated completely homogeneously. After said processes, the surface of the pearlite particles provided in the mixture is electrically loaded and thus, the particles push each other, and thereby flaking is prevented.

Centrifuging (13)

Centrifuging process is applied to the solution in order for the pearlite particles to be separated from the solution comprising pearlite particles as colloid whose surface is modified. During said process, ultra-centrifuge machine is used. The centrifuging process is realized for duration of 5 minutes with speed of 5000 revolution/minute. The centrifuging process is realized 3 times such that washing process is realized in between.

Drying (14)

The pearlite particles, which are precipitated by means of centrifuge and whose surface is modified, are dried between duration of 5-9 hours at 80° C.-100° C. in average. The drying duration may change depending on the liquid phase amount provided in the ambience. As the drying process is finished, the surface modifying process is completed.

Since the surface of the pearlite particles is loaded with the same load as a result of the modification applied, the pearlite particles push each other even if they are in nano dimensions, and thereby they do not tend to flake.

Master-batch Output Comprising Pearlite (20)

In order to add the pearlite, whose dimension is reduced and whose surface is modified for providing said properties to thread, to the polyester-based thread, the pearlite is transformed into master-batch form by using PBT, which is a polymer-based material, as the carrier media. As the carrier media, pluralities of polymers except PBT can be used which are compliant to the structure of the thread used.

Pearlite Addition into PBT (21)

In polyester thread production process, the pearlite has to be homogeneously mixed with PET units. Since it is difficult to homogeneously distribute pearlite in powder form into the PET, master-batch production is realized as an intermediate process. By means of the master-batch process, pearlite is mixed homogeneously into the PBT, whose fluidity is high, in screwed extruders prior to the main production. The mixture comprises grinded pearlite in proportion of 20-40% whose surface is modified; and the mixture also comprises PBT polymer in proportion of 60-80%.

Shaping (22)

The homogeneously mixed pearlite-PBT mixture is cooled and is brought into granule particle form. Finally, master-batch units are obtained in granule form comprising PBT polymer and pearlite in said proportions. Granule formation is provided by means of fragmenting of the extruded melt comprising pearlite-PBT mixture exiting the extruder.

Thread Output Comprising Pearlite (30)

Feeding to the Extruder and Melt Extrusion (31)

The obtained master-batch units comprising pearlite are fed to the extruder of the melt extrusion thread machine where thread production is realized, in order to be melted at a suitable temperature together with the polyethylene terephthalate (PET) units which are to be used in polyester thread production and in order to be mixed in a homogenous manner. The mixture, which is in melt form, is passed through holes provided in the thread production system and having certain dimensions, and said mixture is solidified, and as the final product, multi-filament polyester threads are obtained comprising pearlite particles in nano dimension. The proportion of PBT master-batch units comprising pearlite to the total mixture is 5%, and thus, the pearlite proportion inside the polyester thread which is the final product is 1-2% in average.

Pluralities of tests are realized on the physical properties of standard polyester threads having the properties of 150 denier and 36 filament FDY (completely extruded) not comprising pearlite and the threads comprising pearlite which are produced by means of the same parameters. Thread types are produced which are embodied in two different forms having circular and trilobate cross section. In other words, totally, there are 4 different thread structures. These are as follows:

1. Circular cross-sectioned thread comprising pearlite
2. Trilobate cross-sectioned thread comprising pearlite
3. Circular cross-sectioned thread not comprising pearlite
4. Trilobate cross-sectioned thread not comprising pearlite No difference is observed between the extension values of polyester threads comprising pearlite and polyester threads not comprising pearlite. The resistance values are observed to reduce approximately 20% in circular cross-sectioned thread comprising pearlite, and they are observed to reduce approximately 15% in tribolate cross-sectioned thread comprising pearlite. Even if the resistance values of threads comprising pearlite tend to reduce, they meet the commercial usage standards, and in the weave preparation and production step realized by using said threads, no problem is faced.

Since the thread has a thin structure, the effect of pearlite on the thread in terms of water absorbance, noise insulation, antibacterial protection property and thermal insulation cannot be measured in a firm manner. Therefore, by using standard polyester threads comprising pearlite and by using standard polyester threads not comprising pearlite produced by using the same properties, woven fabrics with the same construction are produced so as to form two separate groups. Water absorbance, thermal conductivity, noise absorption coefficient and antibacterial activity tests are realized on both groups. The applications of these tests are realized according to the standards and conditions described below.

Water Absorbance Test: The measurement is realized according to the ASTM E2149:2010 standard. Accordingly, the water absorption durations of the fabrics in terms of seconds are detected.

Thermal Conductivity Measurement: The measurement is realized according to the ISO 5085-1; 1989 standard in Togmeter Device, and thereby the thermal resistance value is obtained as a result of the test.

Noise Absorbance Coefficient Measurement: The measurement is realized in the Sesx Transmittance Coefficient Measurement Device. In the test realized in the Bruel Kjaer Impedance Tube according to the standard TS EN ISO 10534-2:2003, the noise absorbance coefficient, depending on frequency, is measured for each fabric type.

Measurement of the Antibacterial Activity: In the test realized according to the ATCC 25922 standard by using gram negative type *Escherichia coli* (*E. coli*) microorganism, the reduce percent in the bacteria activity at the end of 24 hours is determined.

The construction parameters and test results belonging to the total six types of fabric samples in the two groups are given in Table 3.

TABLE 3

Construction parameters belonging to the weave fabric samples

| | Group 1 (standard polyester) | | | Group 2 (polyester comprising pearlite) | | |
|---|---|---|---|---|---|---|
| | Type 1 | Type 2 | Type 3 | Type 1 | Type 2 | Type 3 |
| Pattern | Plain weave | Satin | Satin | Plain weave | Satin | Satin |
| Warp thread | 150denier 36filament textured | 150denier 36filament textured | 150denier 36filament FDY 350 T/m | 150denier 36filament textured | 150denier 36filament textured | 150denier 36filament FDY 350 T/m |
| Weft thread | 150denier 36filament textured | 150denier 36filament textured | 150denier 36filament FDY 350 T/m | 150denier 36filament textured | 150denier 36filament textured | 150denier 36filament FDY 350 T/m |
| Warp density (wire/cm) | 60 | 60 | 60 | 60 | 60 | 60 |
| Weft density (wire/cm) | 22 | 25 | 22 | 22 | 25 | 22 |
| Water absorbance (seconds) | 5.6 | 3.4 | 3.6 | 3.6 | 2.6 | 2.4 |
| Thermal resistance ($m^2K/W$) | 0.02459 | 0.01968 | 0.01921 | 0.02720 | 0.03434 | 0.04514 |
| Reduce in Bacterial Activity (%) | 18 | 60 | 56 | 40 | 66 | 62 |
| Noise absorbance coefficient (for 6300 Hz) | 0.41 | 0.13 | 0.11 | 0.52 | 0.35 | 0.23 |

As a result of the tests realized, it is determined that pearlite addition reduces the water absorption durations of fabrics between 24-36%, increases thermal resistance of fabrics between 10-134%, increases the bacteria level decrease percent in the fabrics between 10-122%, increases the noise absorbance coefficients of fabrics in the 2000-6300 Hz frequency range between 17-169%.

The protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

The invention claimed is:

1. A production method for polyester thread comprising pearlite in order to improve the physical properties of polyester threads used in pluralities of sectors like textile products, construction, automotive, defense and medicine and comprising the steps of:

a) melting a polymer based material, desired to be produced as thread, in the screwed extruder;

b) transferring said melt to the melt extrusion thread machine;

c) extruding the melt in said melt extrusion thread machine by passing through holes at certain dimensions;

d) wrapping the extruded thread onto a structure like bobbin, etc.;

characterized by comprising the following sub-steps of:

e) grinding pearlite in an attritor such that the pearlite is reduced to nano dimension prior to step "a";

f) realizing surface modification in order to prevent flaking of pearlite in nano dimension after step "e";

g) taking the pearlite to a polymer based carrier media after step "f" and obtaining polymer master-batch comprising pearlite; and h) adding said master-batches comprising pearlite to step "a" and melting said master-batches together with polymer based main material in the screwed extruder.

2. A functional polyester thread production method according to claim 1, characterized in that the step "f" comprises the sub-steps of:

i) adding an amine solution to water comprising pearlite therein forming a colloid, and mixing the mixture in a mechanical and ultrasonic manner;

ii) centrifuging the colloidal mixture and precipitating the pearlite;

iii) washing the pearlite in order for the excessive solution on the pearlite to be removed, and drying the pearlite in a heater.

3. A functional polyester thread production method according to claim 1, characterized in that the step "g" comprises the sub-steps of:

i) melting the polymer used as the carrier media;

ii) adding pearlite powders, whose surface is modified, into the melt polymer, and mixing thereof; and iii) obtaining master-batch units from the prepared mixture.

* * * * *